US011214415B2

(12) United States Patent
Nojiri et al.

(10) Patent No.: US 11,214,415 B2
(45) Date of Patent: Jan. 4, 2022

(54) LIQUID POURING MEMBER AND CONTAINER

(71) Applicant: KURARAY NORITAKE DENTAL INC., Kurashiki (JP)

(72) Inventors: Yamato Nojiri, Tokyo (JP); Kazutoshi Ikeda, Niigata (JP); Takashi Makabe, Niigata (JP); Yusuke Fujimura, Tokyo (JP); Shuji Bunno, Niigata (JP); Kaori Tada, Ishikawa (JP)

(73) Assignee: KURARAY NORITAKE DENTAL INC., Kurashiki (JP)

( * ) Notice: Subject to any disclaimer, the term of this patent is extended or adjusted under 35 U.S.C. 154(b) by 18 days.

(21) Appl. No.: 16/636,087

(22) PCT Filed: Aug. 3, 2018

(86) PCT No.: PCT/JP2018/029147
§ 371 (c)(1),
(2) Date: Feb. 3, 2020

(87) PCT Pub. No.: WO2019/027025
PCT Pub. Date: Feb. 7, 2019

(65) Prior Publication Data

US 2021/0163191 A1 Jun. 3, 2021

(30) Foreign Application Priority Data

Aug. 4, 2017 (JP) ..... JP2017-151539
May 23, 2018 (JP) ..... JP2018-098531

(51) Int. Cl.
*B65D 47/08* (2006.01)
*B65D 47/12* (2006.01)
*B65D 51/18* (2006.01)

(52) U.S. Cl.
CPC ..... *B65D 47/123* (2013.01); *B65D 47/0814* (2013.01); *B65D 51/18* (2013.01);
(Continued)

(58) Field of Classification Search
CPC .. B65D 47/123; B65D 51/18; B65D 47/0814; B65D 2251/0015; B65D 2251/0087
See application file for complete search history.

(56) References Cited

U.S. PATENT DOCUMENTS 4,413,753 A * 11/1983 Stock ..... B65D 1/0238 222/149
4,498,609 A * 2/1985 Stock ..... B65D 47/18 222/420

(Continued)

FOREIGN PATENT DOCUMENTS

EP 0 416 694 A1 3/1991
FR 1 273 148 A 10/1961

(Continued)

OTHER PUBLICATIONS

International Search Report dated Sep. 4, 2018 in PCT/JP2018/029147, 1 page.

(Continued)

*Primary Examiner* — Frederick C Nicolas
(74) *Attorney, Agent, or Firm* — Oblon, McClelland, Maier & Neustadt, L.L.P.

(57) ABSTRACT

A liquid pouring member capable of effectively preventing the liquid from spouting upon opening. An inner plug includes a nozzle, a base to be engaged with an opening of a container, and a hollow cylindrical skirt. The nozzle includes a nozzle upper part extending from an upper surface of the base and a nozzle lower part extending from a lower surface of the base. The nozzle upper part includes an outlet port, and the nozzle lower part includes an inlet (Continued)

port. An inner passage is formed from the inlet port to the outlet port while penetrating therethrough. The nozzle lower part is formed in a radial inner side of the hollow cylindrical skirt, and includes an end portion with an inclined surface. The inlet port is formed in the inclined surface.

26 Claims, 11 Drawing Sheets

(52) U.S. Cl.
CPC ..... *B65D 2251/0015* (2013.01); *B65D 2251/0087* (2013.01)

(56) References Cited

U.S. PATENT DOCUMENTS 5,221,017 A * 6/1993 Cistone ..... B65D 47/0814 215/235
5,358,151 A * 10/1994 Strasenburgh ..... B65D 47/0814 215/235
6,334,557 B1 * 1/2002 Yang ..... B65D 47/123 222/420
6,915,927 B2 * 7/2005 Stukas ..... B65D 47/123 222/189.06
7,063,241 B2 * 6/2006 Spada ..... A61F 9/0026 222/420
2006/0157516 A1 * 7/2006 Barber ..... A61F 9/0026 222/420
2016/0176593 A1 6/2016 Stolle

FOREIGN PATENT DOCUMENTS

JP 55-63862 U 5/1980
JP 2-48561 U 4/1990
JP 5-40168 U 5/1993
JP 6-28454 Y2 8/1994
JP 11-70962 A 3/1999
JP 2013-230301 A 11/2013
WO WO 2014/177554 A1 11/2014

OTHER PUBLICATIONS

Extended European Search Report dated Mar. 29, 2021 in European Patent Application No. 18840620.1, 6 pages.

* cited by examiner (a)

(b)

(c)

(d)

(a)

(b)

(c)

(a)

(b)

(c)

(d)

(a)

(b)

(c)

(d)

(a)

(b)

(c)

(d)

LIQUID POURING MEMBER AND CONTAINER

TECHNICAL FIELD

The present invention relates to a liquid pouring member and a container.

BACKGROUND ART

A generally employed container has a nozzle attached to a plug fitted to an opening of a container that contains liquid such as liquid medicine so as to be poured to the diseased part. After pouring the liquid, the nozzle is capped. There may be the case that when removing the cap for the subsequent use of the container, the liquid remaining on the inner wall surface of the nozzle is extruded under the internal pressure higher than the external pressure, causing accidental sprouting from the nozzle.

PTL 1 discloses the technique for solving the above-described problem. Referring to FIG. 1 of PTL 1, the plug fitted to the disclosed squeeze container includes a mount fitting cylinder 3 to be internally fitted to the neck portion 2 of the container 1, a straight cylindrical nozzle 5 disposed while projecting from the mount fitting cylinder 3 substantially vertically upward, and an outlet hole 4 penetrating through the nozzle 5. The lower end of the nozzle 5 is formed as an inclined plane marked by substantially T-like symbol.

Each of the nozzle 5 and the outlet hole 4 of the plug in the description of PTL 1 is substantially vertically thin and long shaped. Although the liquid adheres to the inner wall surface of the outlet hole 4 as foam when pouring the liquid, external air flowing into the container 1 through the outlet hole 4 after pouring the liquid forces the foam to fall down to the lower end of the nozzle 5. At this time, the foam falling down to the lower end of the nozzle 5 easily drops into the container 1 along the inclined plane marked by substantially T-like symbol of the lower end of the nozzle 5. This may prevent the liquid that has adhered to the inner wall surface of the outlet hole 4 and the nozzle 5 from being kept remained. Accordingly, the remaining foam-like liquid is never extruded from the outlet hole 4 when removing the cap 8 in the subsequent pouring.

If the liquid remains on the inner wall surface of the mount fitting cylinder 3 (skirt), and in the gap between the inner wall of the skirt 3 and the lower end of the nozzle 5, the remaining liquid may infiltrate into the outlet hole 4 by the capillarity. The disclosed technique as PTL 1 may fail to prevent spouting of the infiltrated liquid under the internal pressure upon removal of the cap 8.

CITATION LIST

Patent Literature

PTL 1: Japanese Utility Model Laid-Open No. 2-48561

SUMMARY OF INVENTION

Technical Problem

The present invention has been made in consideration of the above-described circumstances, and it is an object of the present invention to provide a liquid pouring member and a container, capable of effectively preventing the liquid from spouting upon opening.

Solution to Problem

For the purpose of solving the above-described problem, the present invention provides a liquid pouring member that includes a nozzle, a base to be engaged with an opening of a container, and a hollow cylindrical skirt extending from the base to be fitted into the opening of the container. The nozzle includes a nozzle upper part that extends from an upper surface of the base opposite the skirt, and includes an outlet port for pouring a liquid content from the container, a nozzle lower part that is formed in a radial inner side of the skirt while extending from a lower surface of the base, and includes an inlet port through which the liquid content flows from the container, and an inner passage formed from the inlet port to the outlet port while passing through the nozzle lower part and the nozzle upper part. The nozzle lower part includes an end portion with an inclined surface in which the inlet port is formed. The end portion has at least a part protruding from the skirt. A constriction is formed inside the inner passage of the nozzle lower part. The nozzle lower part and the skirt are configured to form a relatively radially wide portion and a relatively radially narrow portion between the nozzle lower part and an inner wall of the skirt adjacent to the nozzle lower part.

Preferably, the nozzle lower part includes a column portion vertically extending from the lower surface of the base, and the column portion includes a side surface and a bottom surface from which the end portion extends. In this case, more preferably, the bottom surface has the same height as an edge of the skirt.

More preferably, the constriction is formed from a position at the same height as the bottom surface to an inner side of the column portion.

More preferably, an edge portion as an intersection between the side surface and the bottom surface forms an angular portion at an angle of 90°.

The end portion may include a convex portion axially extending along a side surface of the radially narrow portion for guiding falling droplets. Preferably, the convex portion radially protrudes in a range not in excess of a diameter of the column portion.

The nozzle lower part according to another preferred embodiment has no stepped portion, and extends up to the end portion.

In the present invention, the structure having the radially wide and narrow portions may be formed by the means (1) to (3) to be described below, for example.

(1) The nozzle lower part extends from a position on the lower surface of the base, biased from a center of the skirt to form the radially wide and narrow portions. At this time, the nozzle upper part may extend from a biased position on the upper surface of the base in alignment with the nozzle lower part. Alternatively, only the nozzle lower part is biasedly positioned from the center of the skirt, and the nozzle upper part may extend concentrically with the skirt.

(2) The skirt further includes a partial inner circumferential wall that partially surrounds the nozzle lower part in a radial inner side of an outer circumferential wall of the skirt. The radially narrow portion is formed between the nozzle lower part and the partial inner circumferential wall adjacent to the nozzle lower part. The radially wide portion is formed between the nozzle lower part and the inner wall of the skirt adjacent to the nozzle lower part in a region where the partial inner circumferential wall is not formed.

(3) The nozzle lower part includes a portion with relatively large thickness, and a portion with relatively small thickness of an outer circumference of the inner passage. The radially narrow portion is formed between the portion with large thickness and the inner wall of the skirt, and the radially wide portion is formed between the portion with small thickness and the inner wall of the skirt.

Preferably, a length of the inner passage from the constriction to the outlet port is equal to or longer than 5 mm.

Concerning the structure for fitting the member according to the present invention to the container, the base includes a top having the upper surface and the lower surface, and a side surface extending downward from the top. A thread may be formed on an inner wall of the side surface for threaded engagement with a thread formed over an outer circumference of a side surface of the opening of the container. In this embodiment, a cap for closing the outlet port by covering at least the nozzle upper part may be provided. In this case, a thread is formed on an inner wall of the cap, and a thread is formed over an outer circumference of the side surface of the nozzle upper part for threaded engagement with the thread of the cap.

Concerning another structure for fitting the member according to the present invention to the container, the base may be a plate-like member including the upper surface and the lower surface. In this case, the plate-like member is engaged with a top end portion of the opening of the container to lock further entry of the inner plug into the container. In this embodiment, a cap for closing the outlet port by covering at least the nozzle upper part may be provided. In this case, a thread is formed on an inner wall of the cap for threaded engagement with a thread formed over an outer circumference of the side surface of the opening of the container.

According to a preferable embodiment of the present invention, as the capped member, an upper cap for closing the outlet port by covering at least the nozzle upper part may be provided. The base is a lower cap to be fitted to the opening of the container, and the upper cap is pivotally connected to the lower cap to allow opening and closing. Preferably, the upper cap is configured to be engaged with the lower cap in a snap-fit manner when the upper cap is closed.

More preferably, the cap or the upper cap according to the respective embodiments includes a protrusion to be inserted into the outlet port when the cap or the upper cap is closed.

Concerning the member according to the respective embodiments, preferably, the nozzle upper part includes a liquid drip-off portion formed over an outer circumference of an end portion of the nozzle upper part.

The inclined surface of the end portion of the nozzle lower part may be directed to either the wide portion or the narrow portion.

DESCRIPTION OF EMBODIMENTS

Figure 1:
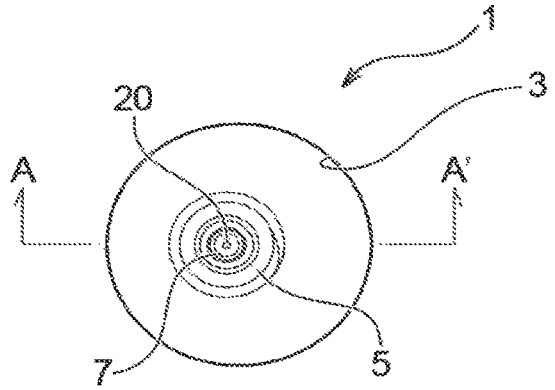
FIG. 1 shows an inner plug according to a first embodiment of the present invention, in which FIG. 1(*a*) is a plan view, FIG. 1(*b*) is a front view, FIG. 1(*c*) is a sectional view taken along line A-A' of FIG. 1(*a*), and FIG. 1(*d*) is a bottom view.
Figure 1:
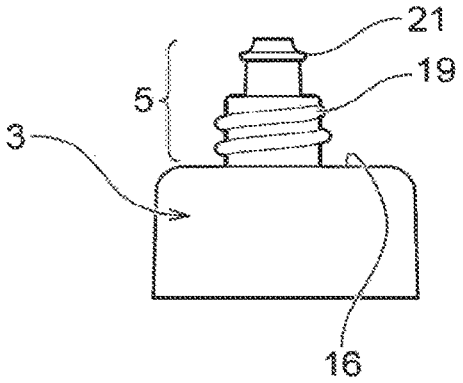
Figure 1:
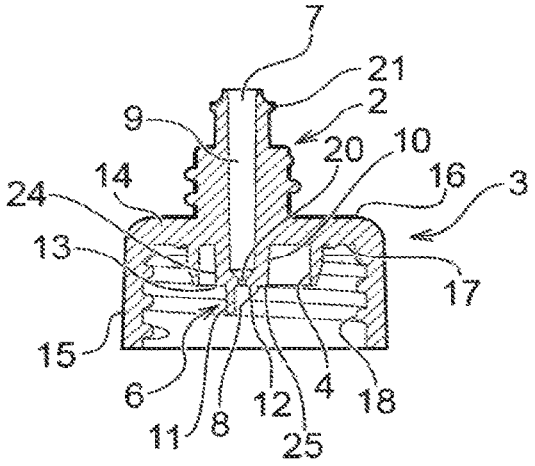
Figure 1:
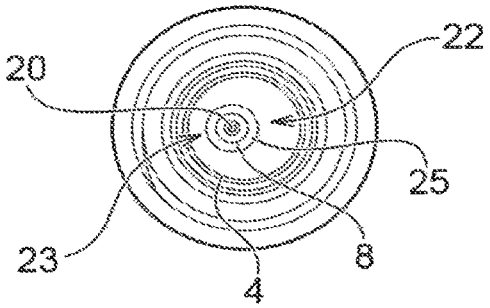

The embodiments according to the present invention will be described below referring to the drawings.

First Embodiment

FIGS. 1(*a*) to 1(*d*) show an inner plug 1 as a liquid pouring member according to a first embodiment of the present invention. The inner plug 1 fitted to a container that contains the liquid content such as the liquid medicine is a member that allows pouring of the liquid content as described below. The inner plug 1 may be produced into an integral part through the injection molding process. However, it may be arbitrarily produced without being limited to the above-described process.

As FIG. 1(*c*) shows, the inner plug 1 includes a nozzle 2, a base 3 to be engaged with an opening of the container (not shown), and a hollow cylindrical skirt 4 extending from the base 3 for fitting to the inner opening of the container. The nozzle 2 includes a nozzle upper part 5 (FIG. 1(*b*)) extending from an upper surface 16 of the base 3 in a direction opposite the skirt 4, and a nozzle lower part 6 extending from a lower surface 17 of the base 3. The nozzle upper part 5 includes an outlet port 7 for pouring the liquid content from the container. The nozzle lower part 6 includes an inlet port 8 into which the liquid content flows from the container. An inner passage 9 is formed from the inlet port 8 to the outlet port 7 while penetrating through the nozzle lower part 6 and the nozzle upper part 5.

Referring further to FIG. 1(*c*), the nozzle lower part 6 is formed in the radial inner side of the skirt 4, and includes an end portion 11 with an inclined surface 12. The inlet port 8 is formed in the inclined surface 12. The nozzle lower part 6 includes a column portion 10 vertically extending from the lower surface 17 of the base 3. The column portion 10 includes a side surface 24 and a bottom surface 25. An edge portion between the side surface 24 and the bottom surface 25 forms an angular portion 13 at an angle of 90°. Preferably, the bottom surface 25 has the same height as an edge of the skirt 4, and has the end portion 11 extending therefrom. In this case, the end portion 11 protrudes from the skirt 4. The inner passage 9 includes a constriction 20 with its sectional area of a passage smaller than that of the other part. Preferably, the constriction 20 is formed at the lower position closer to the end portion 11. More preferably, the constriction 20 is formed into the column portion 10 from the position at the same height as the bottom surface 25. Preferably, the length of the inner passage 9 between the constriction 20 and the outlet port 7 is as long as possible, for example, equal to or longer than 5 mm, and more preferably, equal to or longer than 10 mm.

Referring to FIG. 1(*d*), in the embodiment, the nozzle lower part 6 extends downward from the position on the lower surface 17 biased from the center of the skirt 4, thus forming a radially wide portion 22 and a radially narrow portion 23. In the embodiment, as FIG. 1(*a*) shows, the nozzle upper part 5 also extends from the biased position on the upper surface 16 of the base 3 in alignment with the nozzle lower part 6. As shown in the drawing, the inclined surface 12 of the end portion 11 of the nozzle lower part 6 is directed to the wide portion 22. However, the inclined surface 12 may be directed to the narrow portion 23, for example, or arbitrarily directed without the present invention being limited to the one as described above (applicable to the other embodiment).

Referring to FIG. 1(*c*), the base 3 includes a top 14 having the upper surface 16 and the lower surface 17, and a side surface 15 extending downward from the top 14. A thread 18 is formed on an inner wall of the side surface 15 for threaded engagement with a thread formed over an outer circumference of a side surface of the opening of the container. As FIG. 1(*b*) shows, a thread 19 is formed over an outer circumference of the side surface of the nozzle upper part 5. A liquid drip-off portion 21 is formed over the outer circumference of an end portion of the nozzle upper part 5.

Figure 2:
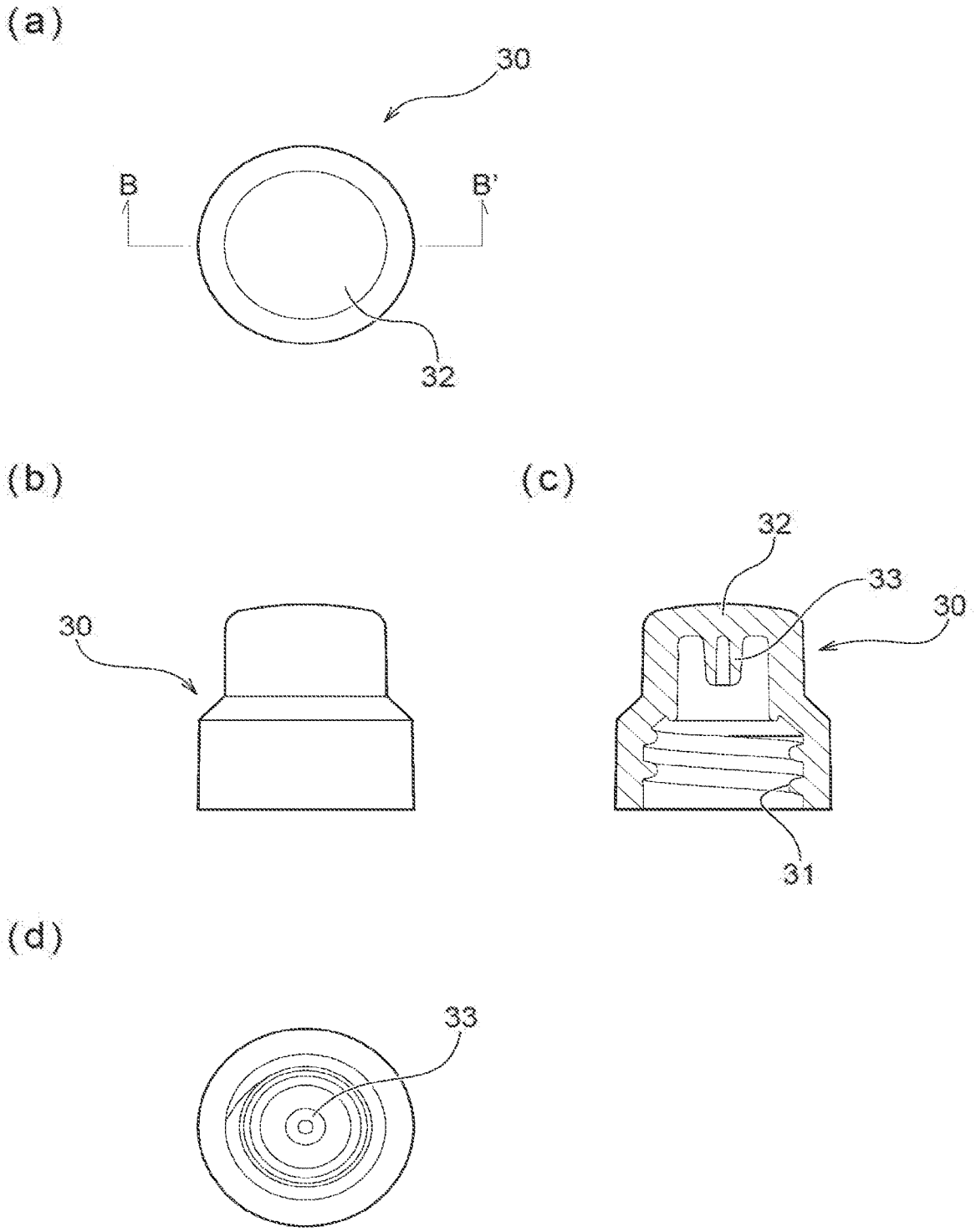
FIG. 2 shows a cap for covering the inner plug as shown in FIG. 1, in which FIG. 2(*a*) is a plan view, FIG. 2(*b*) is a front view, FIG. 2(*c*) is a sectional view taken along line B-B' of FIG. 2(*a*), and FIG. 2(*d*) is a bottom view.

FIG. 2 shows a cap 30 for covering the nozzle upper part 5 of the inner plug 1 as shown in FIG. 1. Referring especially to FIG. 2(*c*), a thread 31 is formed on an inner wall of the cap 30. A protrusion 33 is formed on a back surface of a top plate 32 of the cap 30.

Figure 3:
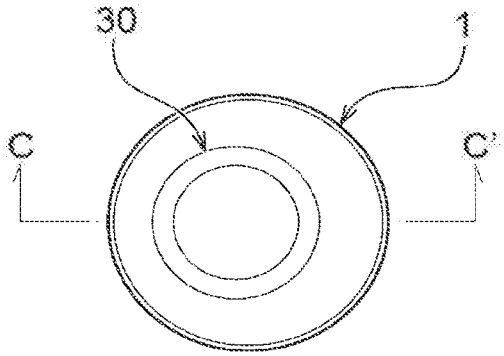
FIG. 3 shows an assembled body formed by fitting the inner plug as shown in FIG. 1 to the container, and closing the inner plug with the cap as shown in FIG. 2, in which FIG. 3(*a*) is a plan view, FIG. 3(*b*) is a front view, and FIG. 3(*c*) is a sectional view taken along line C-C' of FIG. 3(*a*).
Figure 3:
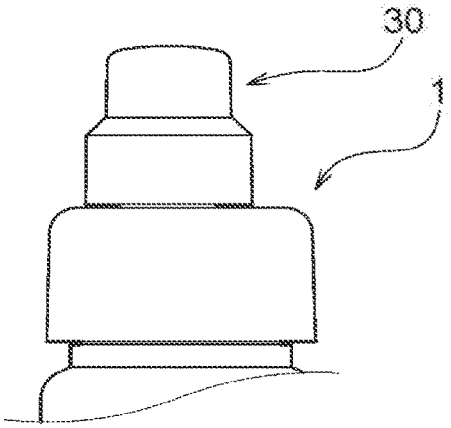
Figure 3:
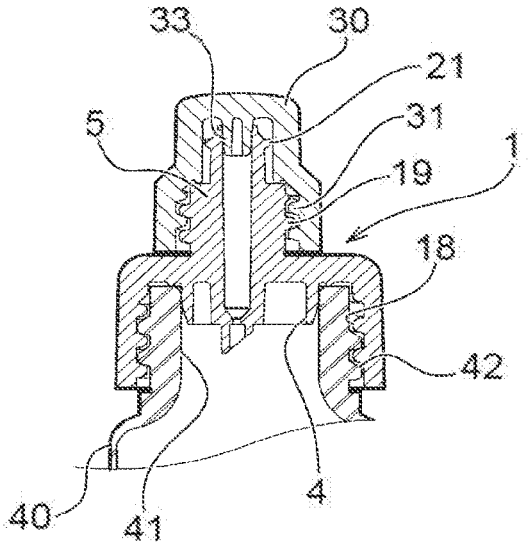

FIG. 3 shows a state in which the inner plug 1 as shown in FIG. 1 is fitted to a container 40, and the cap 30 as shown in FIG. 2 covers the inner plug 1. Referring especially to FIG. 3(*c*), a thread 42 is formed over an outer circumference of the side surface of an opening 41 of the container 40. The thread 18 of the inner plug 1 is threadedly engaged with the thread 42 of the container so that the skirt 4 of the inner plug 1 is fitted to the inside of the open space of the opening 41 of the container 40. Accordingly, the inner plug 1 may be fitted to the container 40.

Threadedly engaging the thread 31 of the cap 30 with the thread 19 of the nozzle upper part 5 allows attachment of the cap 30 to the inner plug 1. At this time, the protrusion 33 of the cap 30 is inserted into the outlet port 7 of the nozzle 2. Accordingly, there is no risk that the liquid content of the container 40 leaks outside while the cap 30 is attached to the inner plug 1. Furthermore, air-tightness in the container may be retained.

Functions of the inner plug 1 according to the first embodiment will be described referring to FIGS. 4 and 5.

Figure 4:
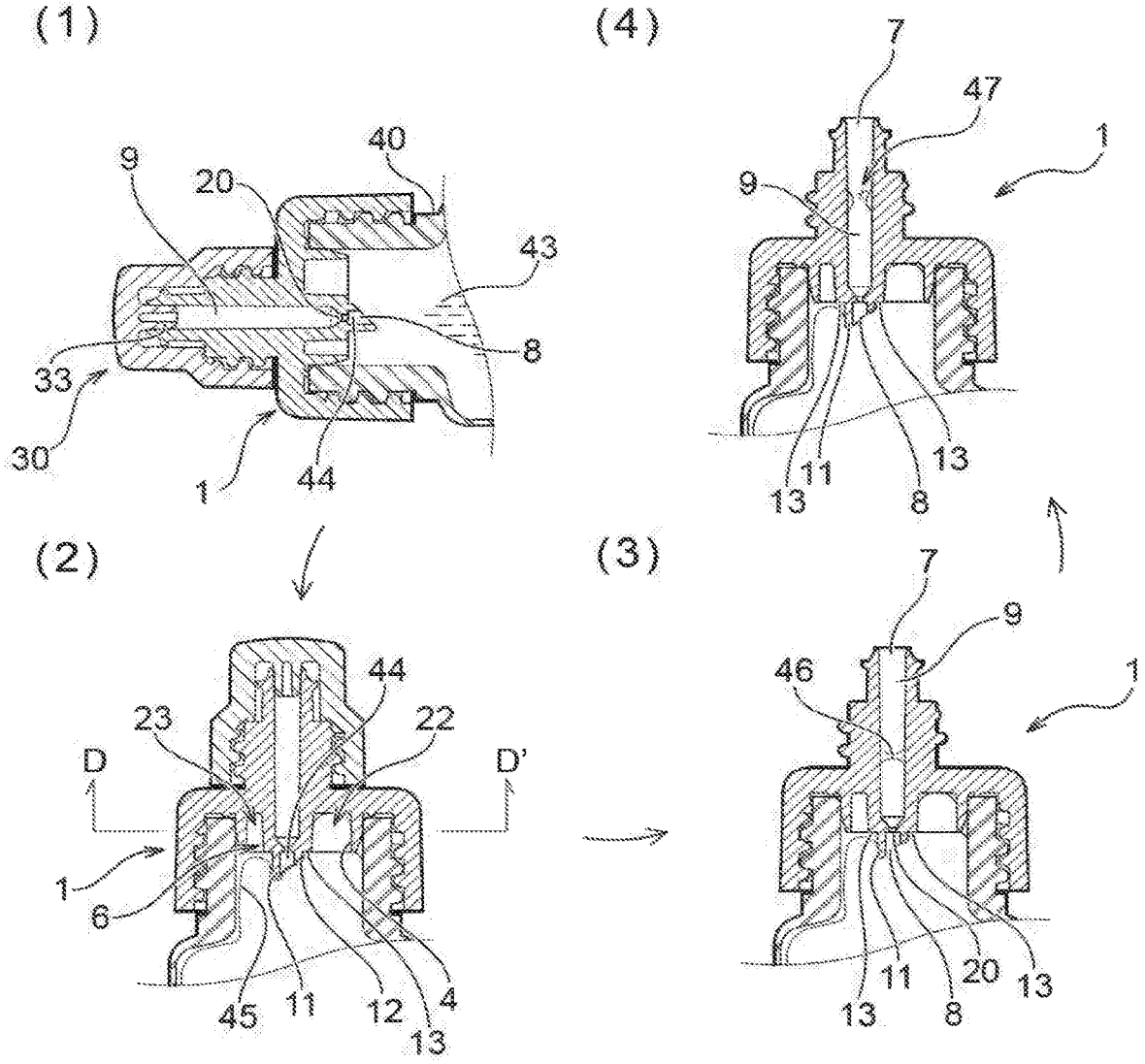
FIG. 4 is an explanatory view representing how the inner plug as shown in FIG. 1 is operated in the use, in which (1) shows a state where the container is filled with liquid, the inner plug as shown in FIG. 1 is fitted to the container as indicated by FIG. 3(*c*), and the capped container is laid sideways, (2) shows a state where the container is brought into an upright posture from the state (1), (3) shows an initial state where the cap is detached from the container in the state (2), and (4) shows the state (3) after passage of short time.

Referring to FIG. 4, the inner plug 1 is fitted to the container 40 as shown in FIG. 3 that contains a liquid content 43 such as the liquid medicine, and is covered with the cap 30. The container is then laid sideways as shown in the state (1) first. In the state (1) in which the container is laid sideways, the liquid content 43 flows into the inlet port 8, and passes through the constriction 20 by the capillarity. As the outlet port 7 is closed with the protrusion 33 of the cap 30, air remains in the inner passage 9. Because of the resultant air pressure, the liquid content 44 that has reached the constriction 20 remains in the inner passage near the constriction 20 and the inlet port 8.

As the state (1) in which the container is laid sideways is brought into the upright posture as indicated by the state (2), the liquid content that has gathered around the inner plug 1 in the state (1) in which the container is laid sideways cannot sustain its own weight, and falls down. Some amount of the liquid content is kept adhering to the inner wall of the inner plug 1 under the surface tension. Referring to FIG. 5, among the liquid content gathered between the nozzle lower part 6 and the inner wall of the skirt 4, the liquid content gathered in the radially wide portion 22 moves toward the narrow portion 23 under the capillary attraction. (see arrow marks of FIG. 5). Referring back to FIG. 4, it is shown that the liquid content 45 that has moved toward the narrow portion 23 and gathered cannot sustain its own weight, thus falling down. The end portion 11 having the inlet port 8 protrudes downward farther than the edge of the skirt 4. Furthermore, as the angular portion 13 at an angle of 90° is formed, the liquid content to be gathered around the inlet port 8 under the capillary attraction may be minimized.

Referring to FIG. 4, detachment of the cap 30 from the container in the state (2) brings the container into the state (3) in which the outlet port 7 is released. As a result, an action for venting expansion force of air remaining in the container works. The internal pressure of the container acts to equalize the outside pressure so that the liquid content gathered around the constriction 20 is forced out to move upward through the inner passage 9 as indicated by a reference numeral 46 in the state (3).

Upon passage of a short time in transition from the state (3) to the state (4), the extruded liquid content splashes before reaching the outlet port 7 while passing through the long inner passage 9 as indicated by a reference numeral 47.

Then air in the container is communicated with outside air to bring the pressure into the ordinary state. The liquid content gathered in the radially narrow portion 23 falls down by its own weight. Even if a small amount of the liquid content remains, the remaining liquid is reduced from the portion around the inlet port 8 upon removal of the cap 30 because of the end portion 11 having the inlet port 8 protruding downward farther than the edge of the skirt 4, and the angular portion 13 at an angle of 90°. This makes it possible to effectively prevent spouting of the remaining liquid upon removal of the cap.

As described above, the embodiment prevents the liquid content from spouting as a result of detaching the cap 30.

The liquid content to be contained in the container 40 includes materials for dental use, for example, the dental adhesive material such as a dental bonding material, the pretreatment agent for dental use such as the dental primer, the denture-base material such as the instantaneous polymerized resin and lining material, the dental lubricant, the dental etching agent, the dental cleaning material, and the medicines for dental use, the medical adhesive, the medicine, industrial adhesive, and medicine. However, arbitrary materials may be contained in the container without the invention being limited to those described above.

Second Embodiment

In the first embodiment, the nozzle 2 is entirely biased from the center of the base 3 and the skirt 4 to form the radially wide portion 22 and the radially narrow portion 23. In the second embodiment according to the present invention, another means is used for forming the radially wide and narrow portions without the invention being limited to the example as described above.

Figure 6:
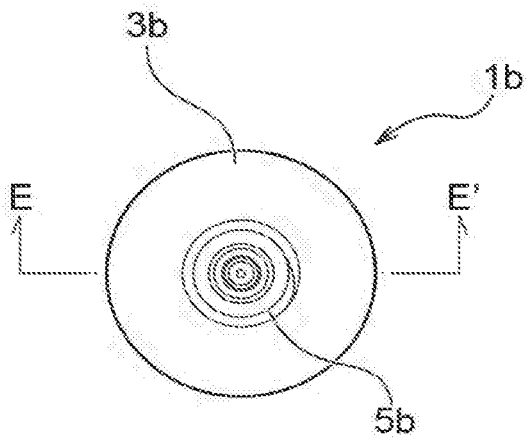
FIG. 6 shows an inner plug according to a second embodiment of the present invention, in which FIG. 6(*a*) is a plan view, FIG. 6(*b*) is a front view, FIG. 6(*c*) is a sectional view taken along line E-E' of FIG. 6(*a*), and FIG. 6(*d*) is a bottom view.
Figure 6:
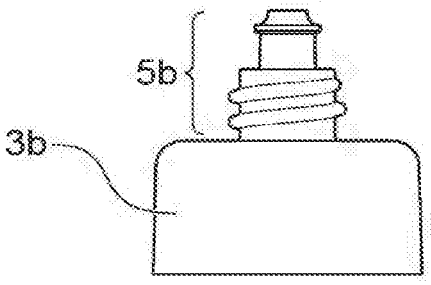
Figure 6:
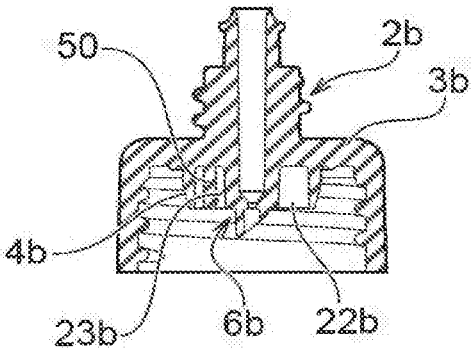
Figure 6:
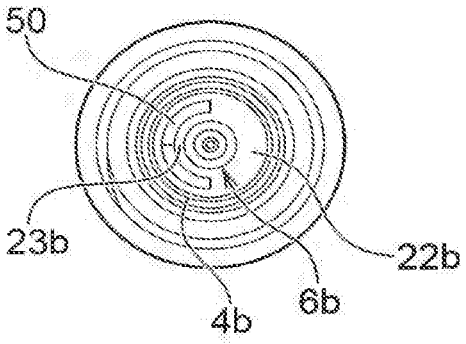

FIG. 6 shows an inner plug 1*b* according to the second embodiment of the present invention. Referring to FIG. 6, no reference numerals are used for designating the similar components to those of the first embodiment, or the same reference numerals suffixed by "b" may be used. The detailed explanation of those components, thus will be omitted.

As FIGS. 6(*a*), 6(*b*), 6(*c*), and 6(*d*) show, a nozzle 2*b* is entirely formed concentrically with a base 3*b*. That is, a nozzle upper part 5*b* and a nozzle lower part 6*b* are formed concentrically with a skirt 4*b*, and not biased unlike the first embodiment.

As FIGS. 6(*c*) and 6(*d*) show, the skirt 4*b* further includes a partial inner circumferential wall 50 that partially surrounds the nozzle lower part 6*b* in the radial inner side of the outer circumferential wall of the skirt 4*b*. As a result, a radially narrow portion 23*b* is formed between the nozzle lower part 6*b* and the partial inner circumferential wall 50 adjacent to the nozzle lower part 6*b*, and a radially wide portion 22*b* is formed between the nozzle lower part 6*b* and the inner wall of the skirt 4*b* adjacent to the nozzle lower part 6*b* in a region where the partial inner circumferential wall 50 is not formed.

The second embodiment may provide the similar effects and advantages to those derived from the first embodiment.

Third Embodiment

A third embodiment includes means for further improving the function of the first embodiment in which the liquid content 45 that has been moved to the narrow portion 23, and gathered with time cannot sustain its own weight, and falls down as shown in the state (2) of FIG. 4.

Figure 7:
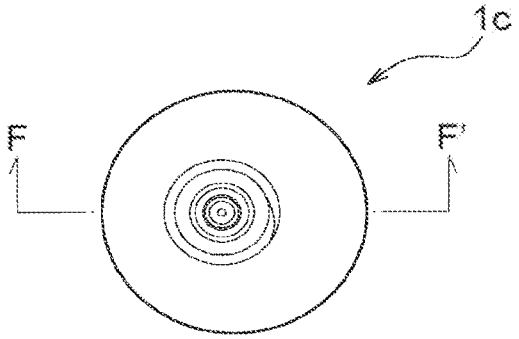
FIG. 7 shows an inner plug according to a third embodiment of the present invention, in which FIG. 7(*a*) is a plan view, FIG. 7(*b*) is a front view, FIG. 7(*c*) is a sectional view taken along line F-F' of FIG. 7(*a*), and FIG. 7(*d*) is a bottom view.
Figure 7:
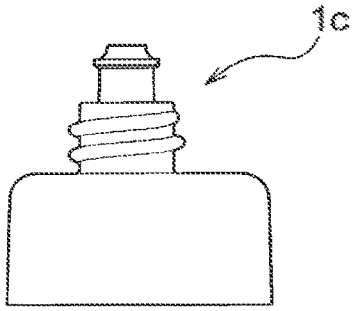
Figure 7:
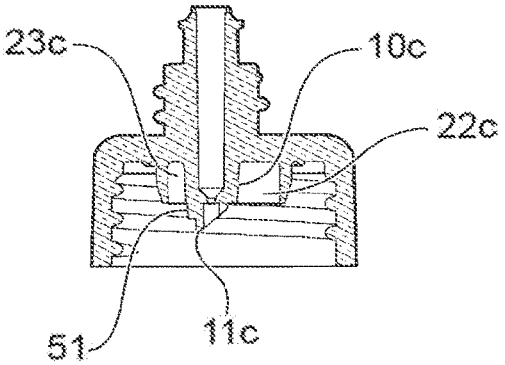
Figure 7:
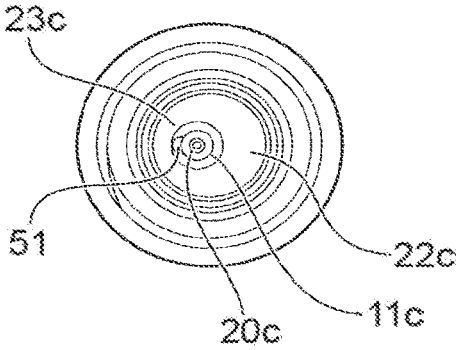

FIG. 7 shows an inner plug 1*c* according to the third embodiment. Referring to FIG. 7, no reference numerals are used for designating the similar components to those of the first embodiment, or the same reference numerals suffixed by "c" may be used. The detailed explanation of those components, thus will be omitted.

As FIGS. 7(*c*) and 7(*d*) show, an end portion 11*c* has a convex portion 51 for guiding falling droplets, axially extending along the side surface of a radially narrow portion 23*c*. The convex portion 51 radially protrudes in a range not in excess of the diameter of a column portion 10*c*.

Figure 5:
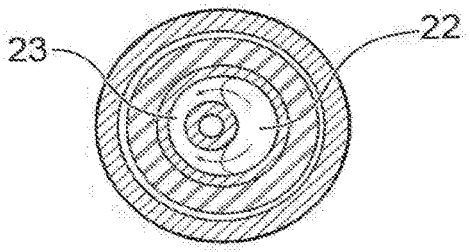
FIG. 5 is a sectional view taken along line D-D' of the state (2) as shown in FIG. 4.

According to the third embodiment, the liquid content that has moved to the narrow portion 23*c*, and gathered with time cannot sustain its own weight, and falls down when bringing the container 40 into the upright posture as indicated by the state (2) of FIG. 4 and FIG. 5. As the convex portion 51 serves to guide the falling droplets, it is possible to reduce the remaining liquid more effectively.

FIG. 7 shows an example having the convex portion 51 for guiding the falling droplets added to the structure of the first embodiment. This applies to the second embodiment as described above, and the fourth to sixth embodiments to be described later.

Fourth Embodiment

In the first embodiment, the nozzle 2 is entirely biased from the center of the base 3 and the skirt 4 to form the radially wide portion 22 and the radially narrow portion 23. A fourth embodiment of the present invention corresponds to a modified example of the first embodiment.

Figure 8:
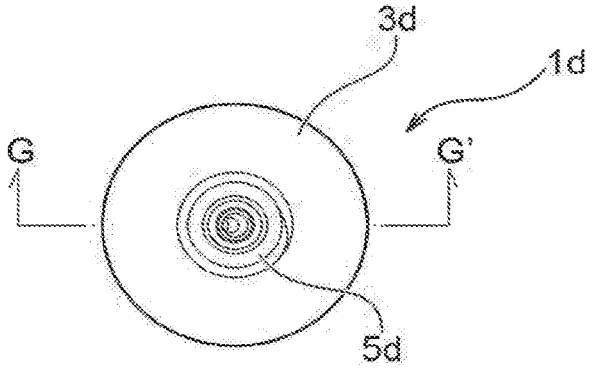
FIG. 8 shows an inner plug according to a fourth embodiment of the present invention, in which FIG. 8(*a*) is a plan view, FIG. 8(*b*) is a front view, FIG. 8(*c*) is a sectional view taken along line G-G' of FIG. 8(*a*), and FIG. 8(*d*) is a bottom view.
Figure 8:
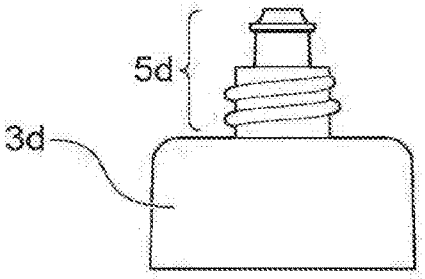
Figure 8:
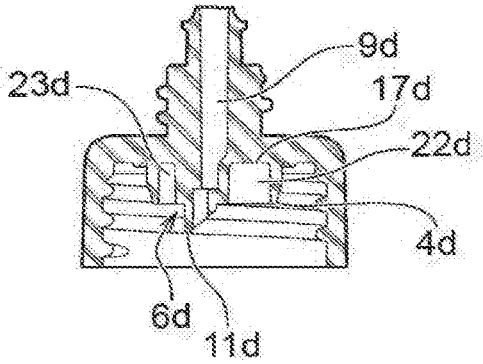
Figure 8:
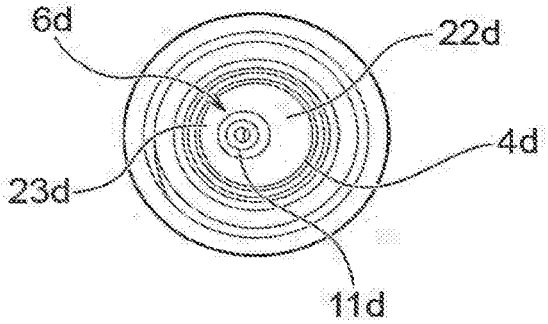

FIG. 8 shows an inner plug 1*d* according to the fourth embodiment of the present invention. Referring to FIG. 8, no reference numerals are used for designating the similar components to those of the first embodiment, or the same reference numerals suffixed by "d" may be used. The detailed explanation of those components, thus will be omitted.

As FIGS. 8(*a*), 8(*b*), and 8(*c*) show, a nozzle upper part 5*d* of the fourth embodiment is formed concentrically with a base 3*d* and a skirt 4*d*.

As FIGS. 8(*c*) and 8(*d*) show, likewise the first embodiment, a nozzle lower part 6*d* extends from a position on a lower surface 17*d* of the base 3*d*, biased from the center of the skirt 4*d* to form a radially wide portion 22*d* and a radially narrow portion 23*d* between the nozzle lower part 6*d* and an inner wall of the skirt 4*d* adjacent to the nozzle lower part 6*d*.

As described above, in the fourth embodiment, the nozzle upper part 5*d* and the nozzle lower part 6*d* are not aligned with each other, an inner passage 9*d* has a part that is bent in the nozzle lower part 6*d* as shown in FIG. 8(*c*). The effects and advantages similar to those of the first embodiment may be derived from the fourth embodiment. As the nozzle upper part 5*d* is positioned at the center of the inner plug 1*d*, the cap may have the same axial center as that of the container.

Fifth Embodiment

In the first and the fourth embodiments, at least the nozzle lower part is biased from the center of the skirt to form the radially wide and narrow portions. In the second embodiment, the partial inner circumferential wall 50 is provided to form the radially wide and narrow portions. The present invention is not limited to the above-described examples. In a fifth embodiment according to the present invention, another means is provided to form the radially wide and narrow portions. In an example according to the fifth embodiment, the cap is differently shaped.

Figure 9:
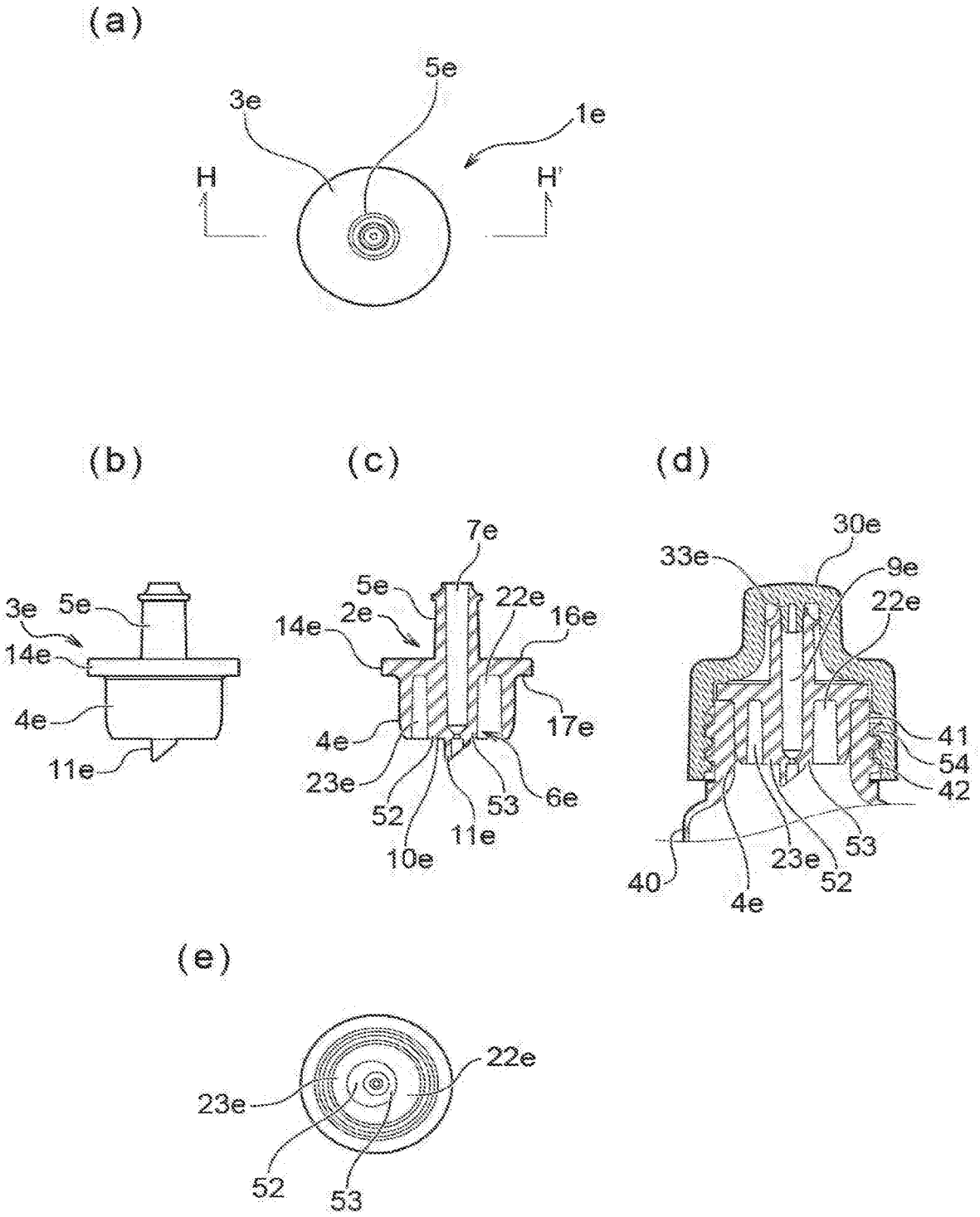
FIG. 9 shows an inner plug according to a fifth embodiment of the present invention, in which FIG. 9(*a*) is a plan view, FIG. 9(*b*) is a front view, FIG. 9(*c*) is a sectional view taken along line H-H' of FIG. 9(*a*), and FIG. 9(*d*) is a sectional view representing a state where the inner plug as shown in FIG. 9(*c*) is fitted to the container, and capped, and FIG. 9(*e*) is a bottom view.

FIG. 9 shows an inner plug 1*e* according to the fifth embodiment of the present invention. Referring to FIG. 9, no reference numerals are used for designating the similar components to those of the first embodiment, or the same reference numerals suffixed by "e" may be used. The detailed explanation of those components, thus will be omitted.

As FIGS. 9(*a*) to 9(*d*) show, a nozzle 2*e* according to the fifth embodiment is entirely formed substantially concentrically with a base 3*e*. That is, a nozzle upper part 5*e* and an end portion 11*e* of a nozzle lower part 6*e* are formed concentrically with a skirt 4*e*, and not biased unlike the first embodiment.

As FIGS. 9(*c*) to 9(*e*) show, an outer circumference (column portion 10*e*) in an inner passage 9*e* of the nozzle lower part 6*e* has a relatively thick portion 52, and a relatively thin portion 53. A radially narrow portion 23*e* is formed between the thick portion 52 and the inner wall of the skirt 4*e*, and a radially wide portion 22*e* is formed between the thin portion 53 and the inner wall of the skirt 4*e*.

The effects and advantages similar to those of the first embodiment may be derived from the fifth embodiment.

As FIGS. 9(*b*) and 9(*c*) show, the base 3*e* of the inner plug 1*e* according to the fifth embodiment is a plate-like member 14*e* having an upper surface 16*e* and a lower surface 17*e*. As FIG. 9(*d*) shows, the plate-like member 14*e* is engaged with a top end portion of the opening 41 of the container 40 to lock further entry of the inner plug 1*e* into the container 40.

The nozzle upper part 5*e* according to the fifth embodiment has no thread to be threadedly engaged with the thread of the cap, but is adaptable to a cap 30*e* (FIG. 9(*d*)) different from the cap 30 as shown in FIG. 2. The cap 30*e* has a thread 54 on its inner wall. The thread 54 is threadedly engaged with the thread 42 formed over the outer circumference of the side surface of the opening 41 of the container 40 to allow the cap 30*e* to be attached to the container 40 to which the inner plug 1*e* is fitted. At this time, a protrusion 33*e* of the cap 30*e* may be fitted to an outlet port 7*e* of the nozzle.

The fitting structure of the inner plug 1*e*, and the structure of the cap 30*e* according to the fifth embodiment are applicable to the respective embodiments described above so long as they are structurally configurable. For example, the fitting structure and the cap 30*e* as shown in FIG. 9(*d*) are easily applicable to the embodiment, for example, having the nozzle upper part not biased from the center of the skirt.

Sixth Embodiment

As the cap for the inner plug of the respective embodiments according to the present invention, the cap 30 as shown in FIG. 2, and the cap 30*e* as shown in FIG. 9(*d*) have been described. A sixth embodiment will provide a cap differently structured from those as described in the embodiments.

Figure 10:
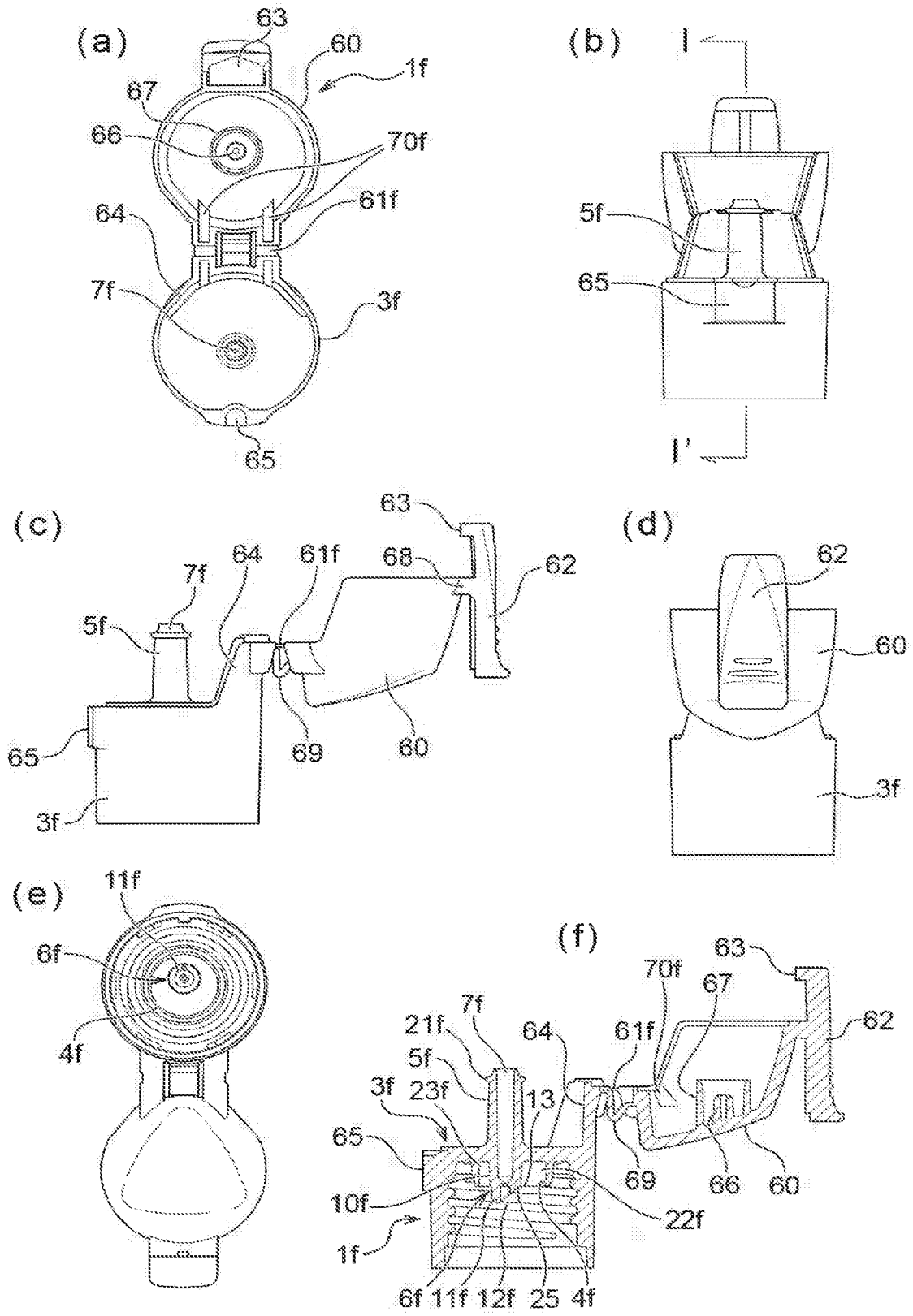
FIG. 10 shows a hinged cap in an opened state according to a sixth embodiment of the present invention, in which FIG. 10(*a*) is a plan view, FIG. 10(*b*) is a front view, FIG. 10(*c*) is a right side view, FIG. 10(*d*) is a back view, FIG. 10(*e*) is a bottom view, and FIG. 10(*f*) is a sectional view taken along line of FIG. 10(*b*).
Figure 11:
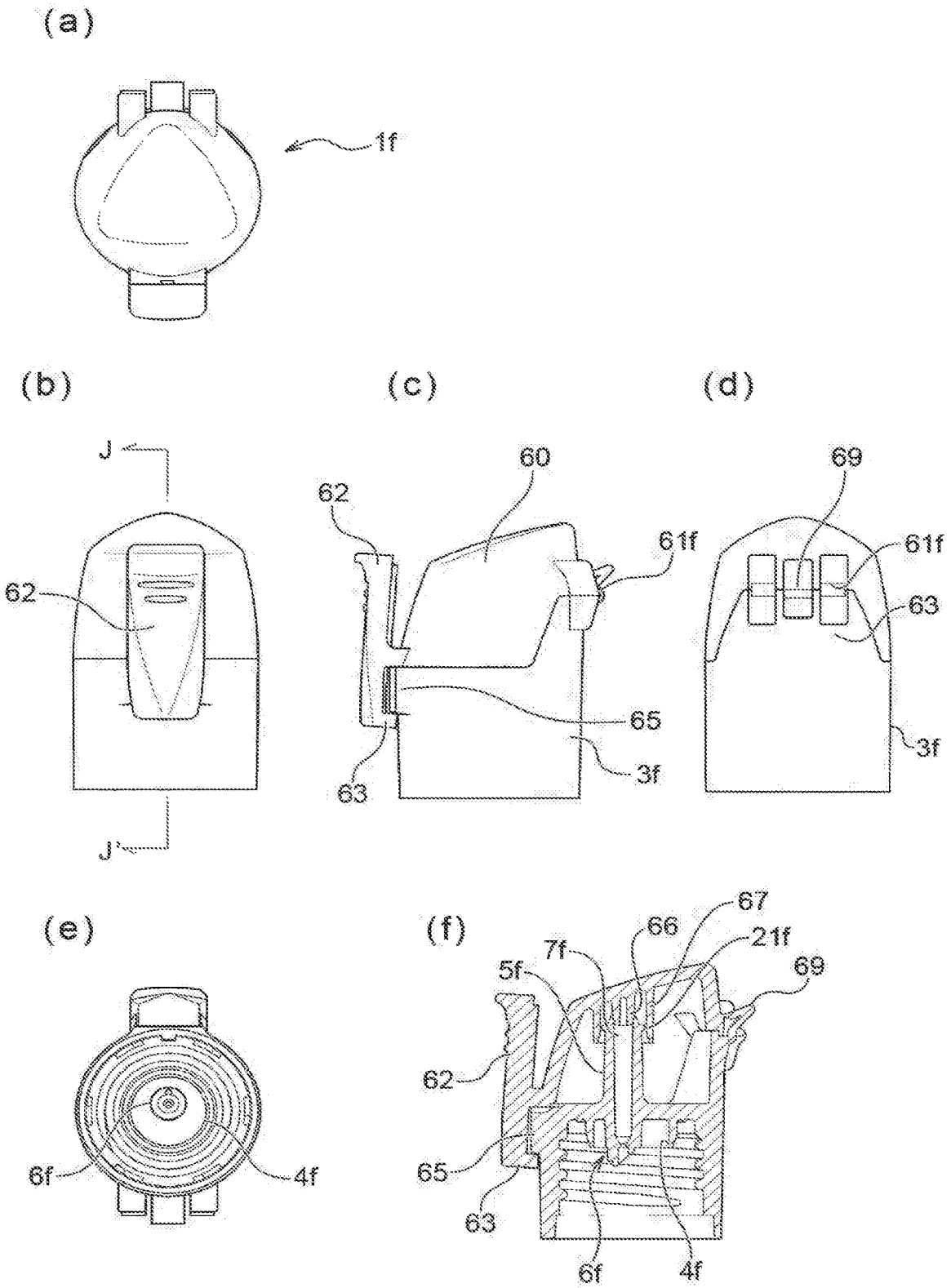
FIG. 11 shows the hinged cap in a closed state according to the sixth embodiment of the present invention, in which FIG. 11(*a*) is a plan view, FIG. 11(*b*) is a front view, FIG. 11(*c*) is a right side view, FIG. 11(*d*) is a back view, FIG. 11(*e*) is a bottom view, and FIG. 11(*f*) is a sectional view taken along line J-J' of FIG. 11(*b*).

FIG. 10 shows a hinged cap if according to the sixth embodiment of the present invention in an opened state. FIG. 11 shows that the hinged cap if is in a closed state.

Referring to FIG. 10, especially to FIGS. 10(*c*) and 10(*f*), a lower cap 3*f* of the hinged cap 1*f* includes a hinge support portion 64, and a locking portion 65 formed at a side counter to the hinge support portion 64. An upper cap 60 is pivotally connected to the hinge support portion 64 via a hinge 61*f* and a spring 69. A lever 62 elastically pivoting about a fulcrum 68 is disposed above the upper cap 60. A hook 63 is formed at an end portion of the lever 62. As FIGS. 10(*a*) and 10(*f*) show, a protrusion 66 is formed on a back surface of a top plate of the upper cap 60. A guard 67 is formed around the protrusion 66.

As FIGS. 11(*b*) to 11(*d*), and 11(*f*) show, when pivotally moving the upper cap 60 toward the nozzle upper part 5*f*, both edges of the upper cap 60 and the lower cap 3*f* are tightly engaged to close the hinged cap 1*f*. At this moment, the hook 63 of the lever 62 is engaged with the locking portion 65 of the lower cap 3*f* in a snap-fit manner for locking so that the upper cap 60 is not carelessly opened. For opening the upper cap 60, the upper portion (at the side of a finger catcher) of the lever 62 is pressed toward the axial center to easily release the engagement between the hook 63 and the locking portion 65 so that the upper cap 60 is opened. As FIG. 11(*f*) shows, when the upper cap 60 is closed, the protrusion 66 is inserted into an outlet port 7*f* of the nozzle upper part 5*f*. This may prevent the liquid content in the container from leaking out in the closed state of the upper cap 60, and retain air-tightness in the container. The nozzle upper part has a liquid drip-off portion 21*f* formed thereon. As FIGS. 10(*a*) and 10(*f*) show, the upper cap 60 has a portion with further reduction in thickness, that is, a thinned portion 70*f*.

The structure of the nozzle has been described in the sixth embodiment, taking the first embodiment as the example. It is also possible to apply the structure of the nozzle according to any one of the second to the fourth embodiments to the sixth embodiment.

Seventh Embodiment

A seventh embodiment is a modified example of the hinged cap according to the sixth embodiment. The similar components to those of the sixth embodiment will be designated with the same reference numerals, and the components corresponding to the sixth embodiment will be designated with the same reference numerals suffixed by "g". The detailed description will be made with respect only to the feature different from the sixth embodiment.

Figure 12:
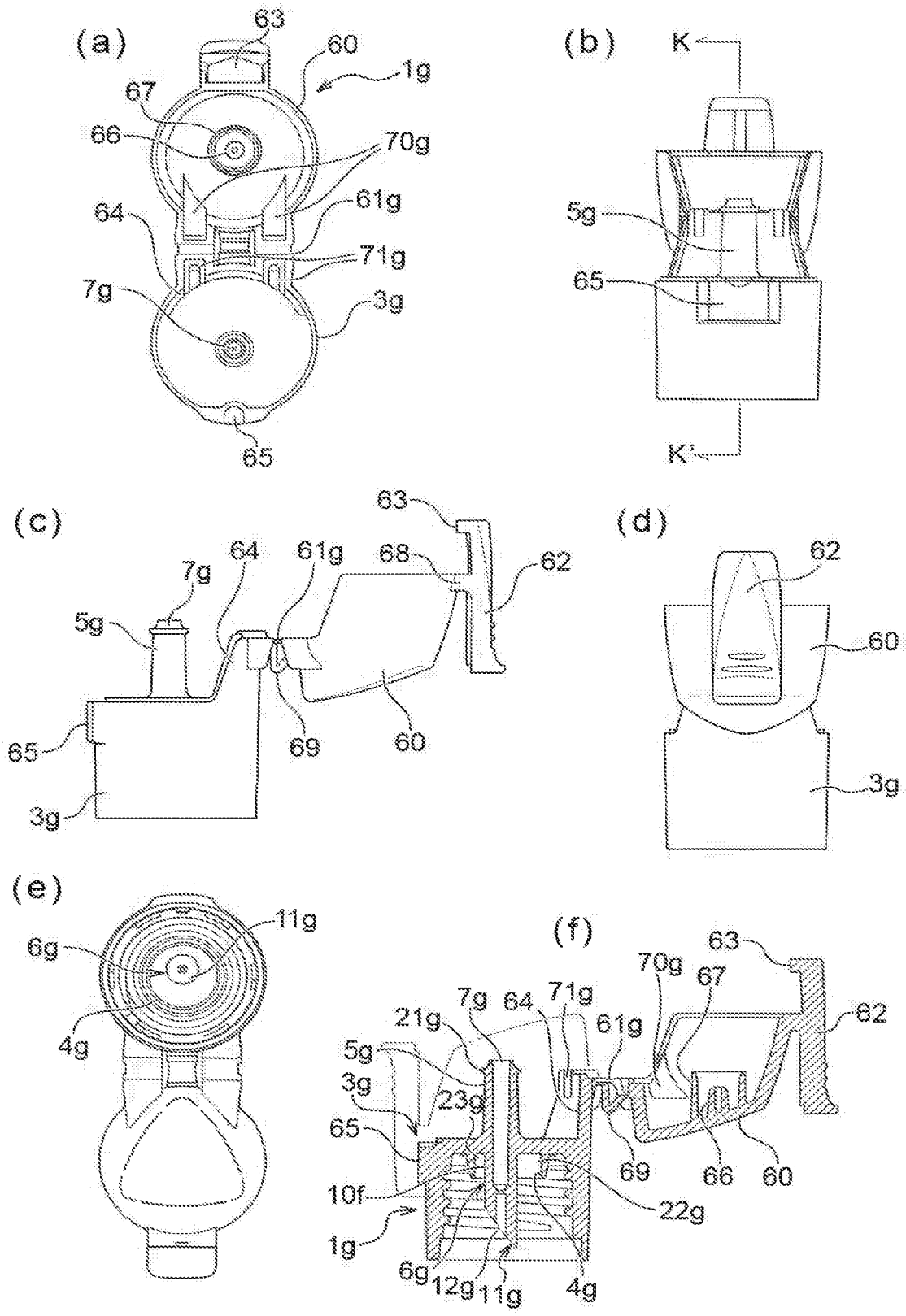
FIG. 12 shows a hinged cap in an opened state according to a seventh embodiment of the present invention, in which FIG. 12(*a*) is a plan view, FIG. 12(*b*) is a front view, FIG. 12(*c*) is a right side view, FIG. 12(*d*) is a back view, FIG. 12(*e*) is a bottom view, and FIG. 12(*f*) is a sectional view taken along line K-K' of FIG. 12(*b*).

FIG. 12 shows a hinged cap 1*g* according to a seventh embodiment of the present invention in an opened state.

As FIG. 12(*a*) shows, a hinge 61*g* according to the seventh embodiment has its strength enhanced by increasing its width larger than that of the hinge 61*f* according to the sixth embodiment. As FIGS. 12(*a*) and 12(*f*) show, a thinned portion 70*g* of the upper cap 60 is larger than the thinned portion 70*f* according to the sixth embodiment. Accordingly, a lower cap 3*g* has a thinner portion, that is, a thinned portion 71*g*. This makes it possible to suppress the weight increase as a result of enlarging the hinge 61*g*.

Likewise the first embodiment, the end portion 11*f* of the nozzle lower part 6*f* according to the sixth embodiment extends from the bottom surface 25 of a column portion 10*f* to form the angular portion 13. Meanwhile, a nozzle lower part 6*g* according to the seventh embodiment extends straight to an end portion 11*g* while having no stepped portion. That is, in the seventh embodiment, components corresponding to the bottom surface 25 of the column portion 10*f*, and the angular portion 13 are not formed (Feature 1). The nozzle lower part 6*g* according to the seventh embodiment allows its side surface of the portion from the lower surface to the end portion 11*g* to be differently shaped from the column portion as described in other embodiments.

An inclined surface 12*f* of the end portion 11*f* according to the sixth embodiment is directed to the wide portion 22*f*.

Meanwhile, an inclined surface 12*g* of the end portion 11*g* according to the seventh embodiment is directed to a narrow portion 23*g* (Feature 2).

The respective embodiments according to the present invention have been described. The present invention is not limited to those examples but may be arbitrarily modified. It is possible to apply the feature of an embodiment to the other embodiment so long as it is structurally configurable. For example, at least one of the features 1 and 2 of the nozzle structure according to the seventh embodiment may be applied to the first to the sixth embodiments. It is also possible to apply either the feature 1 or 2 to the seventh embodiment.

REFERENCE SIGNS LIST

1, 1*b*, 1*c*, 1*d*, 1*e* inner plug
1*f*, 1*g* hinged cap
2, 2*b*, 2*e* nozzle
3, 3*b*, 3*d*, 3*e* base
3*f*, 3*g* lower cap
4, 4*b*, 4*d*, 4*e*, 4*f*, 4*g* skirt
5, 5*b*, 5*d*, 5*e*, 5*f*, 5*g* nozzle upper part
6, 6*b*, 6*d*, 6*e*, 6*f*, 6*g* nozzle lower part
7, 7*e*, 7*f*, 7*g* outlet port
8 inlet port
9, 9*e*, 9*d* inner passage
10, 10*c*, 10*e*, 10*f* column portion
11, 11*c*, 11*d*, 11*e*, 11*f*, 11*g* end portion
12, 12*f*, 12*g* inclined surface
13 angular portion
14 top
14*e* plate-like member
15 side surface
16, 16*e* upper surface
17, 17*e* lower surface
18 thread (inner plug)
19 thread (nozzle upper part)
20, 20*c* constriction
21, 21*f*, 21*g* liquid drip-off portion
22, 22*b*, 22*c*, 22*d*, 22*e*, 22*f*, 22*g* wide portion
23, 23*b*, 23*c*, 23*d*, 23*e*, 23*f*, 23*g* narrow portion
24 side surface
25 bottom surface
30, 30*e* cap
31 thread (cap)
32 top plate
33, 33*e* protrusion
40 container
41 opening (container)
42 thread (container)
43 liquid content (inside the container)
44 liquid content (constriction)
45 liquid content (narrow portion)
46 liquid content (inner passage)
47 splashed liquid content
50 partial inner circumferential wall
51 convex portion
52 portion with relatively large thickness
53 portion with relatively small thickness
54 thread (inner wall of the cap)
60 upper cap
61*f*, 61*g* hinge
62 lever
63 hook
64 hinge support portion
65 locking portion
66 protrusion
67 guard
68 fulcrum
69 spring
701, 70*g*, 71*g* thinned portion

The invention claimed is:

1. A liquid pouring member, comprising:
a nozzle;
a base to be engaged with an opening of a container;
a hollow cylindrical skirt extending from the base to be fitted into the opening of the container; wherein:
the nozzle comprises:
a nozzle upper part extending from an upper surface of the base opposite the hollow cylindrical skirt, the nozzle upper part comprising an outlet port for pouring a liquid content from the container;
a nozzle lower part formed in a radial inner side of the hollow cylindrical skirt while extending from a lower surface of the base, the nozzle lower part comprising an inlet port through which the liquid content flows from the container; and
an inner passage formed from the inlet port to the outlet port while passing through the nozzle lower part and the nozzle upper part,
wherein the nozzle lower part comprises an end portion with an inclined surface in which the inlet port is formed, the end portion having at least a part protruding from the hollow cylindrical skirt;
a constriction is formed inside the inner passage of the nozzle lower part; and
the nozzle lower part and the hollow cylindrical skirt are configured to form a relatively radially wide portion and a relatively radially narrow portion between the nozzle lower part and an inner wall of the hollow cylindrical skirt adjacent to the nozzle lower part.

2. The liquid pouring member according to claim 1, wherein:
the nozzle lower part comprises a column portion vertically extending from the lower surface of the base; and
the column portion comprises a side surface and a bottom surface from which the end portion extends.

3. The liquid pouring member according to claim 2, wherein the bottom surface has the same height as an edge of the hollow cylindrical skirt.

4. The liquid pouring member according to claim 2, wherein the constriction is formed from a position at the same height as the bottom surface to an inner side of the column portion.

5. The liquid pouring member according to claim 2, wherein an edge portion as an intersection between the side surface and the bottom surface forms an angular portion at an angle of 90°.

6. The liquid pouring member according to claim 2, wherein the end portion comprises a convex portion axially extending along a side surface of the relatively radially narrow portion for guiding falling droplets.

7. The liquid pouring member according to claim 6, wherein the convex portion radially protrudes in a range not in excess of a diameter of the column portion.

8. The liquid pouring member according to claim 1, wherein the nozzle lower part with no stepped portion extends up to the end portion.

9. The liquid pouring member according to claim 1, wherein the nozzle lower part extends from a position on the lower surface of the base, biased from a center of the hollow cylindrical skirt to form the relatively radially wide and narrow portions.

10. The liquid pouring member according to claim 9, wherein the nozzle upper part extends from a biased position on the upper surface of the base in alignment with the nozzle lower part.

11. The liquid pouring member according to claim 9, wherein only the nozzle lower part is biasedly positioned from the center of the hollow cylindrical skirt, and the nozzle upper part extends concentrically with the hollow cylindrical skirt.

12. The liquid pouring member according to claim 1, wherein:

the hollow cylindrical skirt further comprises a partial inner circumferential wall that partially surrounds the nozzle lower part in a radial inner side of an outer circumferential wall of the hollow cylindrical skirt;

the relatively radially narrow portion is formed between the nozzle lower part and the partial inner circumferential wall adjacent to the nozzle lower part; and the relatively radially wide portion is formed between the nozzle lower part and the inner wall of the hollow cylindrical skirt adjacent to the nozzle lower part in a region where the partial inner circumferential wall is not formed.

13. The liquid pouring member according to claim 1, wherein:

the nozzle lower part comprises a portion with relatively large thickness of an outer circumference of the inner passage, and a portion with relatively small thickness of the outer circumference;

the relatively radially narrow portion is formed between the portion with large thickness and the inner wall of the hollow cylindrical skirt, and the relatively radially wide portion is formed between the portion with small thickness and the inner wall of the hollow cylindrical skirt.

14. The liquid pouring member according to claim 1, wherein a length of the inner passage from the constriction to the outlet port is equal to or longer than 5 mm.

15. The liquid pouring member according to claim 1, wherein:

the base comprises a top having the upper surface and the lower surface, and a side surface extending downward from the top; and a thread is formed on an inner wall of the side surface for threaded engagement with a thread formed over an outer circumference of a side surface of the opening of the container.

16. The liquid pouring member according to claim 1, wherein:

the base is a plate-like member comprising the upper surface and the lower surface; and the plate-like member is engaged with a top end portion of the opening of the container to lock further entry of an inner plug into the container.

17. The liquid pouring member according to claim 15, further comprising a cap for closing the outlet port by covering at least the nozzle upper part, wherein:

a thread is formed on an inner wall of the cap; and a thread is formed over an outer circumference of the side surface of the nozzle upper part for threaded engagement with the thread of the cap.

18. The liquid pouring member according to claim 16, further comprising a cap for closing the outlet port by covering at least the nozzle upper part, wherein a thread is formed on an inner wall of the cap for threaded engagement with a thread formed over an outer circumference of the side surface of the opening of the container.

19. The liquid pouring member according to claim 1, further comprising an upper cap for closing the outlet port by covering at least the nozzle upper part, wherein:

the base is a lower cap to be fitted to the opening of the container; and the upper cap is pivotally connected to the lower cap to allow opening and closing.

20. The liquid pouring member according to claim 19, wherein the upper cap is engaged with the lower cap in a snap-fit manner when the upper cap is closed.

21. The liquid pouring member according to claim 17, wherein the cap comprises a protrusion to be inserted into the outlet port when the cap is closed.

22. The liquid pouring member according to claim 19, wherein the upper cap comprises a protrusion to be inserted into the outlet port when the upper cap is closed.

23. The liquid pouring member according to claim 17, wherein the nozzle upper part comprises a liquid drip-off portion formed over an outer circumference of an end portion of the nozzle upper part.

24. The liquid pouring member according to claim 1, wherein the inclined surface of the end portion of the nozzle lower part is directed to the relatively wide portion.

25. The liquid pouring member according to claim 1, wherein the inclined surface of the end portion of the nozzle lower part is directed to the relatively radially narrow portion.

26. The container comprising the liquid pouring member according to claim 1 fitted to the container.

* * * * *